United States Patent [19]

Reisman

[11] 3,952,499

[45] Apr. 27, 1976

[54] WATCH CASES, DIALS AND BEZELS

[76] Inventor: Emeric Reisman, 4705 16th Ave., Brooklyn, N.Y. 11204

[22] Filed: Mar. 4, 1975

[21] Appl. No.: 555,235

[52] U.S. Cl. ..... 58/88 R; 58/53; 58/55; 58/91

[51] Int. Cl.[2] ..... G04B 19/24; G04B 37/06

[58] Field of Search ..... 58/53, 55, 88 R, 90 R, 58/91

[56] References Cited

UNITED STATES PATENTS

| | | | |
|---|---|---|---|
| 3,030,763 | 4/1962 | Klingenberg | 58/91 |
| 3,307,346 | 3/1967 | Klingenberg | 58/91 |
| 3,386,239 | 6/1968 | Shiffman | 58/91 |
| 3,495,398 | 2/1970 | Widmer et al. | 58/91 |
| 3,807,236 | 4/1974 | Leone | 58/88 R |

*Primary Examiner*—Edith Simmons Jackmon

[57] ABSTRACT

A one piece construction forming the dial, cover and casing for a timepiece movement.

2 Claims, 5 Drawing Figures

WATCH CASES, DIALS AND BEZELS

This invention relates to the construction of watch cases and its primary object is, to provide the features of a watch case, a watch dial and a bezel, all, in a one-piece, inseparable unit.

One of the foundations of the present invention is the recognition that the main function of a watch case is to accomodate the movement, the dial and the crystal.

Because of the steadily increasing variety of movements and watch cases on the market, it is a constant burden to the manufacturer to stock a wide variety of parts that will co-act within the watch case and it will be in harmony with each design.

Another disadvantage is being experienced in the trade, when due to faulty parts, frequently the dial cannot be positioned perfectly inside the watch case, resulting in an off-centered dial. To correct this problem, will always involve the waste of some material and the loss of production time.

It is therefore, the principal object of the present invention to provide a novel watch case that already contains the dial, printed on the surface of the case itself, consequently, this dial becoming an inseparable part thereof. The need for a separate watch dial, as it is known today, is thereby eliminated.

Another object of the present invention to permit the elimination of a separate bezel, as it is being used today.

The aforementioned innovations will result in a great reduction, both in cost of material and of labor.

The objects, characteristics and advantages of the present invention will be more fully understood from the following detailed description thereof when read in conjunction with the accompanying drawing, in which.

Figure 1:
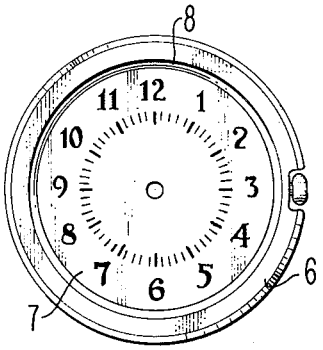
FIG. 1 is a front elevational view of the watch case.
Figure 2:
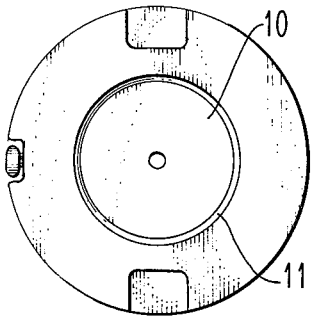
FIG. 2 is a rear elevational view of the watch case.
Figure 3:
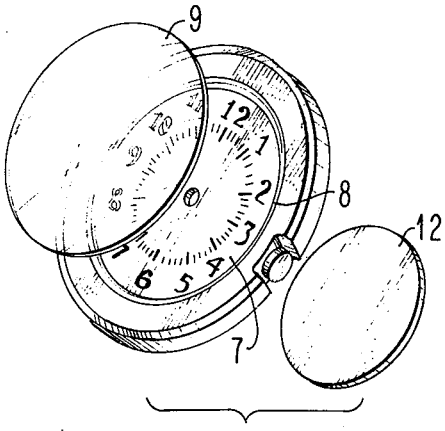
FIG. 3 is a fragmentary front perspective view of the main external parts of a watch.
Figure 4:
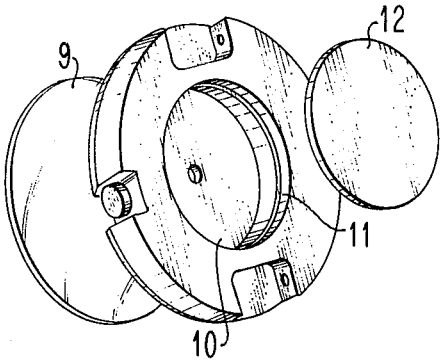
FIG. 4 is a fragmentary rear perspective view of the structure shown in FIG. 4.
Figure 5:
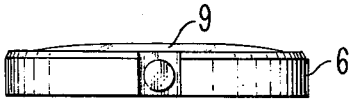
FIG. 5 is a side edge view of the watch case.

Referring now to the drawings FIGS. 1 to 5 for a more detailed description thereof, numeral 6 points to the body of the invention, namely, to the compact watchcase, made of one solid piece. The watchcase 6 may, of course, be made of any suitable rigid materials, natural or man-made, such as precious semi-recious metals, stones, synthetic placstics, ivory, etc., or the combinations of them.

In accordance, with one of the main objects of this invention, the numeral 7 indicates the inside ledge around the watch case where a flat surface is for the customary numbers and symbols to be printed, engraved, embossed, stamped, baked or in anyway mounted directly on the very material of the watch case itself, and so create a permanent, inseparable watch dial.

It will, of course, be clear to those skilled in the art of watchmaking that having thus eliminated the need for a separate watch dial, all other problems connected with the positioning of various types of dial-legs, pins or screws are consequently, completely eliminated.

Referring to other innovations of the watch case, the numeral 8 indicates a groove or thread, along the periphery of the permanent dial being cut into the shoulder material of the one-piece watch case. This groove 8 will allow the crystal 9 to be snapped or placed into position and is retained in the usual manner.

The rear of the watch case has a circular opening 10 in its center and is intended to receive the movement. After the movement of the watch is inserted through the rear opening 10 a ring — not shown — will hold the works securely in its place. Movements of any size and shape may be accomodated inside the watch case 6 with the aid of a suitable ring — not shown — which will follow the contours of the movement and fill out the hollow gap inside the case.

The drawing further illustrates that the circular rear opening 10 also provides for a groove 11 or thread to retain a disk 12 which serves as a cover and protection for the works inside the watch case.

Quite obviously, the principles of the present invention are applicable to watches for both male and female adults as well as children, whether said watches are geometrically or artistically shaped and worn as pocket, wrist or pendant-watches, etc.

It will be therefore, understood that the description or preferred embodiments of the present invention has been made for purposes of illustration only and that the several structural features and relationships disclosed may be modified in various ways none of which involves a departure from the spirit and scope of the present invention.

Having thus described by invention, what I claim as new and desire to secure by Letters Patent is:

1. A one piece construction forming the entire top cover for a timepiece movement except at the center thereof comprising the dial for the timepiece and the entire case therefor except at the bottom surface of the movement, said case having a groove thereon for receipt of a crystal.

2. The construction of claim 1 further having a hole at the bottom thereof for receipt of a bottom cover for said movement.

* * * * *